US006526767B1

(12) United States Patent
Lopes

(10) Patent No.: US 6,526,767 B1
(45) Date of Patent: Mar. 4, 2003

(54) AUTOMATIC DEFROST SYSTEM FOR A REFRIGERATING DEVICE

(75) Inventor: Luiz Antonio Diemer Lopes, Joinville (BR)

(73) Assignee: Mul'Tibras S. A. Eletrodomesticos, Sao Paulo (BR)

( * ) Notice: Subject to any disclaimer, the term of this patent is extended or adjusted under 35 U.S.C. 154(b) by 0 days.

(21) Appl. No.: 09/980,392

(22) PCT Filed: Jun. 20, 2000

(86) PCT No.: PCT/BR00/00067

§ 371 (c)(1),
(2), (4) Date: Apr. 1, 2002

(87) PCT Pub. No.: WO00/79193

PCT Pub. Date: Dec. 28, 2000

(30) Foreign Application Priority Data

Jun. 22, 1999 (BR) ..... 9903093

(51) Int. Cl.[7] ..... F25D 21/06; F25B 47/00
(52) U.S. Cl. ..... 62/151; 62/80; 62/277
(58) Field of Search ..... 62/151, 80, 277, 62/156, 278, 426, 513, 82, 150, 408, 409, 419

(56) References Cited

U.S. PATENT DOCUMENTS

| | | | | |
|---|---|---|---|---|
| 4,006,601 A | | 2/1977 | Ballarin et al. | 62/80 |
| 4,344,294 A | * | 8/1982 | Gelbard | 62/155 |
| 5,669,222 A | * | 9/1997 | Jaster et al. | 62/156 |
| 6,286,326 B1 | * | 9/2001 | Kopko | 62/179 |

FOREIGN PATENT DOCUMENTS

| | | | |
|---|---|---|---|
| FR | 2 508 143 A | 12/1982 | F24D/11/02 |

* cited by examiner

*Primary Examiner*—Chen-wen Jiang
(74) *Attorney, Agent, or Firm*—Darby & Darby

(57) ABSTRACT

An automatic defrost system for a refrigerating device, comprising, in a cabinet, an evaporator and a condenser, and a defrost air circuit having: a first circuit portion; a second circuit portion receiving a certain defrost airflow from the first circuit portion and positioned adjacent to the condenser, in order to be heated by the latter; a third circuit portion, which is positioned adjacent to the evaporator, so as to selectively heat it when the heated defrost airflow passes through the second circuit portion and to conduct the defrost airflow to the first circuit portion; and a valve means, which selectively permits the passage of the defrost airflow from the second circuit portion to the third circuit portion.

7 Claims, 2 Drawing Sheets

AUTOMATIC DEFROST SYSTEM FOR A REFRIGERATING DEVICE

FIELD OF THE INVENTION

The present invention refers to an automatic defrost system of the evaporator of refrigerating devices, to be applied to refrigerators and freezers, in which the evaporator may be provided isolated from the refrigeration compartment during defrost operations, particularly in the "no frost" type refrigerators.

BACKGROUND OF THE INVENTION

The refrigerator constructions provided with a freezing compartment of the "no frost" type usually present automatic defrost of the evaporator. Ice formation in the evaporator occurs due to the existence of humidity in this region, resulting from the air returning from any of the refrigerating and freezing compartments. In order that defrost may occur, the control system of these devices instructs, periodically, the actuation of a heat source, such as a resistor.

In this condition, the compressor is automatically turned off and an electric resistance, which is provided adjacent to the evaporator, is energized by a current, whose intensity is known and predetermined as a function of the amount of heat needed to eliminate only the undesired ice layer formed in the evaporator, without impairing the refrigeration of the internal environment of the cabinet.

The energization of the resistance promotes a superficial heating of the evaporator plate, gradually melting all the ice formed on the plate, which ice, when liquefied, is drained outwardly from the refrigeration environment.

The ice acts as a thermal insulating element, making difficult the heat transfer between the evaporator and the air returning from the refrigerating and freezing compartments, resulting in a degradation of the refrigeration system characterized by an increase of energy consumption, since the refrigeration system has to work more to comply with the operational conditions and/or the increase of the internal temperature of the refrigeration environments.

Thus, the localized ice formation in the evaporator requires a periodic defrost operation. With this localized ice formation, such defrost operation has to be executed more frequently, increasing energy consumption.

DISCLOSURE OF THE INVENTION

Thus, it is an objective of the present invention to provide an automatic defrost system for refrigerators and freezers, which promotes the automatic defrost of said equipments with minimum energetic consumption. Another objective of the present invention is to provide a defrost system for refrigerators and freezers, such as cited above, in which the consumed energy for promoting the automatic defrost of said equipments is obtained from the dissipation of energy of said equipments.

These and other objectives are achieved by an automatic defrost system for a refrigerating device, whose cabinet comprises a freezing compartment and a refrigerating compartment, a refrigeration circuit including a condenser and an evaporator, and a refrigeration forced air circuit comprising said compartments and the evaporator, further comprising a defrost air circuit having: a first circuit portion, through which flows a certain defrost airflow; a second circuit portion receiving the defrost airflow from the first circuit portion and positioned adjacent to the condenser, in order to exchange heat with the latter and heat the defrost airflow; a third circuit portion, which selectively receives, from the second circuit portion, the defrost airflow, and which is positioned adjacent to the evaporator, so as to be in direct contact with the latter and heat it when the refrigerating device is under a defrost condition, and conducting the defrost airflow to the first circuit portion; and a valve means, which selectively permits the passage of the defrost airflow from the second circuit portion to the third circuit portion, upon occurrence of a certain ice formation condition in the evaporator, and blocks said passage of defrost airflow, upon completion of the defrost in the evaporator.

BRIEF DESCRIPTION OF THE DRAWINGS

The invention will be described below, with reference to the attached drawings, in which.

BEST MODE OF CARRYING OUT THE PRESENT INVENTION

Figure 1:
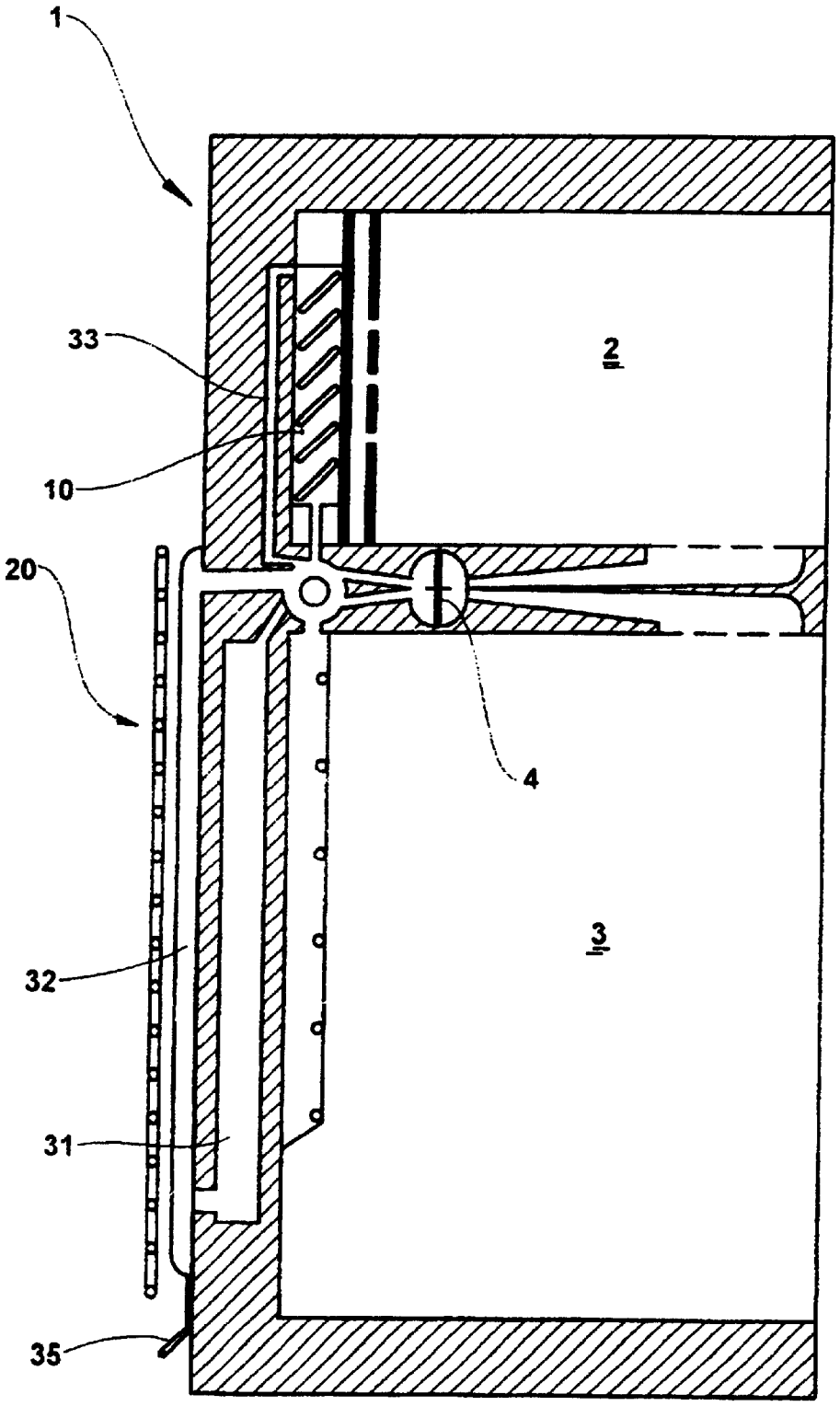
FIG. 1 illustrates, schematically and in a vertical longitudinal sectional view, a refrigerating device having a cabinet, inside which are defined a freezing compartment and a refrigerating compartment, provided with the defrost circuit of the present invention.
Figure 2:
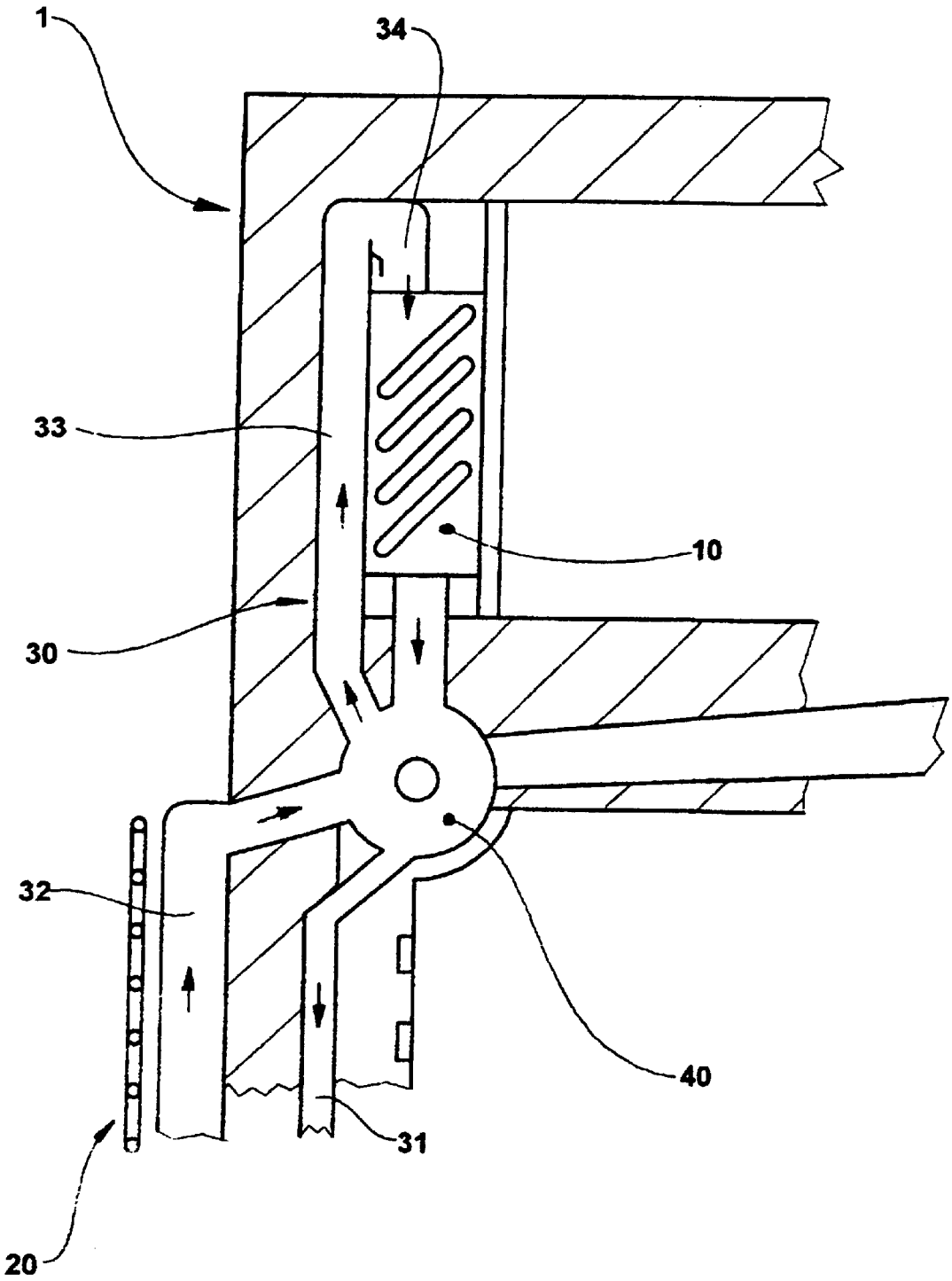
FIG. 2 illustrates, schematically and in a partial vertical longitudinal sectional view, the region of the cabinet where the valve of the present invention is mounted.

The present invention will be described in relation to a refrigerating device having, inside a cabinet 1, at least one freezing compartment 2 and a refrigerating compartment 3, a refrigeration circuit including an evaporator 10 and a condenser 20, which are interconnected by conventional connecting ducts, and a refrigeration forced air circuit comprising the freezing and refrigerating compartments 2 and 3, the evaporator 10 and a fan 4, which promotes the circulation of a refrigeration airflow from the evaporator 10 to said compartments and, from the latter, back to the evaporator 10. In the illustrated embodiment, the evaporator 10 is positioned in a plenum adjacent and external to the freezing compartment 2.

According to the present invention, the defrost of the evaporator 10 is accomplished when a certain defrost airflow passes therethrough, which air has been previously heated during its passage through the condenser 20 and which flows through a defrost air circuit 30 by natural convection, for example.

According to the present invention, the defrost air circuit 30 has a first circuit portion 31, through which flows the defrost airflow received from the evaporator 10 before being conducted to a substantially lower region of the condenser 20, where the first circuit portion 31 opens to a second circuit portion 32.

The second circuit portion 32 is provided adjacent to the condenser 20, in order to exchange heat therewith, using the heat generated in said condenser 20 to heat the defrost airflow received from the first circuit portion 31. The second circuit portion 32 acts as an air reservoir, where the air remains until it is heated and able to flow upwardly, by natural convection, reaching the evaporator 10 through a third circuit portion 33.

In the illustrated embodiment, the first circuit portion 31 is provided, downwardly, at a lower portion of a rear wall of the cabinet 1, for example in the form of a vertical duct defined on said wall, the second circuit portion 32 being externally provided and mounted onto the rear wall of the cabinet 1, occupying practically the whole width and the whole vertical extension of the condenser 20, in order to maximize the use of the heat produced thereby.

Upon passing through the plenum in which the evaporator 10 is located, the heated airflow melts the ice in the evaporator 10 and returns, through a descending extension 34 of the third circuit portion 33, to the first circuit portion 31, said defrost airflow continuing to circulate in the defrost air circuit 30 while the defrost condition lasts.

The third circuit portion 33 is provided adjacent to the evaporator 10, selectively receiving the heated defrost airflow in the second circuit portion 32, in order to heat the evaporator 10, when the refrigerating device is under a defrost condition, and selectively conducting the defrost airflow to the first circuit portion 31, after exchanging heat with the evaporator 10.

In the construction of the present invention, the descending extension is defined through the evaporator 10, coinciding with part of the refrigeration forced air circuit. In another construction of the present invention, not illustrated, the third circuit portion 33 surrounds the evaporator 10 or is only adjacent thereto, defining a circuit condition that is closed in relation to the defrost air circuit 30, without using part of the refrigeration forced air circuit.

The defrost air circuit 30 further presents a valve means 40, which selectively permits the passage of the defrost airflow from the second circuit portion 32 to the third circuit portion 33, upon occurrence of said certain ice formation condition in the evaporator 10, and blocks said passage of defrost airflow upon completion of the defrost in the evaporator 10.

In the construction of the present invention, the defrost air circuit 30 has a multi-way valve, which simultaneously permits said passage of defrost airflow through the defrost air circuit 30 and blocks the passage of refrigeration air from the freezing and refrigerating compartments 2 and 3 to the evaporator 10, upon occurring said certain ice formation in the evaporator 10.

In the defrost operational condition, a non-illustrated control unit instructs the valve means 40 to modify its blocking condition between the third circuit portion 33 and the second circuit portion 32, and to interrupt, temporarily, the refrigeration of the freezing and refrigerating compartments 2 and 3.

In the illustrated construction, the valve means 40 is provided upstream the evaporator 10, at an air return portion of the refrigeration forced air circuit, and it usually maintains interrupted the fluid communication between the third circuit portion 33 and the second circuit portion 32 of the defrost air circuit. In this condition, said valve 40 allows only the fluid communication of the freezing and refrigerating compartments 2 and 3 with the evaporator 10.

For defrost to occur in the construction of the present invention, it is necessary that, once defined the defrost operational condition in the refrigerating device, a compressor (not illustrated) of the refrigeration system of this device should be "off", not generating cold any more. After some instants of the compressor stop have elapsed, the valve means 40 is instructed to modify its operational condition.

In the "on" condition of the compressor, the condenser reaches temperatures of six or seven degrees centigrade above room temperature. In these temperatures, the heat of the condenser 20 heats, by radiation during its operation, the entire second circuit portion 32 of the defrost air circuit 30. When defrost is promoted, there is water formation in the defrost air circuit 30, which water is drained to a drain 35 provided at a lower region of the second circuit portion 32.

The construction of the present invention provides an automatic defrost for refrigerators and freezers to which it is applied, more efficiently than the conventional automatic defrost system with resistance.

What is claimed is:

1. An automatic defrost system for a refrigerating device, whose cabinet (1) comprises a freezing compartment (2) and a refrigerating compartment (3), a refrigeration circuit including a condenser (20) and an evaporator (10), and a refrigeration forced air circuit comprising said compartments (2 and 3) and the evaporator (10), characterized in that it further comprises a defrost air circuit (30) through which the defrost air flows by natural convection and having: a first circuit portion (31), through which flows a certain defrost airflow; a second circuit portion (32) receiving the defrost airflow from the first circuit portion (31) and positioned adjacent to the condenser (20), in order to exchange heat with the latter and heat the defrost airflow; a third circuit portion (33), which selectively receives, from the second circuit portion (32), the defrost airflow, and which is positioned adjacent to the evaporator (10), so as to be in direct contact with the latter and heat it when the refrigerating device is under a defrost condition, and conducting the defrost airflow to the first circuit portion (31); and a valve means (40), which selectively permits the passage of the defrost airflow from the second circuit portion (32) to the third circuit portion (33), upon occurrence of a certain ice formation condition in the evaporator, and blocks said passage of defrost airflow, upon completion of the defrost in the evaporator (10).

2. System, as in claim 1, characterized in that the third circuit portion (33) comprises a descending extension (34), which defines the part of the refrigeration forced air circuit that contains the evaporator (10).

3. System, as in claim 2, characterized in that the valve means (40) comprises a multi-way valve, which allows the passage of the defrost airflow through the defrost air circuit, and simultaneously blocks the passage of the refrigeration air from the freezing and refrigerating compartments (2 and 3) to the evaporator (10), upon occurring said certain ice formation in the evaporator (10).

4. System, as in claim 3, characterized in that the multi-way valve is mounted in the refrigeration forced air circuit at a region of said circuit where air returns from the freezing and refrigerating compartments (2, 3).

5. System, as in claim 4, characterized in that the second circuit portion (32) occupies an area extension substantially corresponding to that of the condenser (20).

6. System, as in claim 5, characterized in that the second circuit portion (32) is provided externally to an adjacent rear wall portion of the cabinet (1), the first and the third circuit portions (31, 33) being provided on the rear wall of the cabinet (1), respectively adjacent to the refrigerating compartment (2) and to the freezing compartment (3).

7. System, as in claim 6, characterized in that it comprises a drain (35) provided at a lower region of the second circuit portion (32).

* * * * *

UNITED STATES PATENT AND TRADEMARK OFFICE

CERTIFICATE OF CORRECTION

PATENT NO. : 6,526,767 B1
DATED : March 4, 2003
INVENTOR(S) : Luiz A. Diemer Lopes It is certified that error appears in the above-identified patent and that said Letters Patent is hereby corrected as shown below:

Title page,
Item [73], Assignee, delete "Mul'Tibras S. A. Eletrodomesticos" and substitute with -- Multibras S.A. Eletrodomesticos --.

Signed and Sealed this

Twenty-ninth Day of July, 2003

JAMES E. ROGAN
*Director of the United States Patent and Trademark Office*